United States Patent [19]

Taft

[11] Patent Number: 4,666,117

[45] Date of Patent: May 19, 1987

[54] LOW PROFILE SHELF LOCK

[75] Inventor: John R. Taft, Duxbury, Mass.

[73] Assignee: P.X. Industries, Inc., W. Hanover, Mass.

[21] Appl. No.: 785,865

[22] Filed: Oct. 9, 1985

[51] Int. Cl.[4] ..... A47B 57/04

[52] U.S. Cl. ..... 248/243; 108/108; 211/187; 248/250

[58] Field of Search ..... 248/235, 239, 243, 250; 211/187; 108/108, 109

[56] References Cited

U.S. PATENT DOCUMENTS

| | | | |
|---|---|---|---|
| 3,471,111 | 10/1969 | MacDonald | 248/235 |
| 3,471,112 | 10/1969 | MacDonald et al. | 248/239 |
| 3,870,266 | 3/1975 | MacDonald | 248/235 |
| 3,979,796 | 9/1976 | MacDonald | 24/73 |
| 4,037,813 | 7/1977 | Loui et al. | 248/250 |
| 4,053,132 | 10/1977 | Del Pozzo | 248/250 X |
| 4,385,565 | 5/1983 | Roberts et al. | 248/235 X |
| 4,432,523 | 2/1984 | Follows | 248/250 X |

FOREIGN PATENT DOCUMENTS

| | | | |
|---|---|---|---|
| 260460 | 3/1968 | Austria | 248/250 |
| 389197 | 6/1965 | Switzerland | 248/235 |
| 1540224 | 2/1979 | United Kingdom | 248/250 |

*Primary Examiner*—J. Franklin Foss
*Assistant Examiner*—David L. Talbott
*Attorney, Agent, or Firm*—Morse, Altman & Dacey

[57] ABSTRACT

A low profile shelf lock of improved construction is disclosed for securing shelves in cabinets and the like. The shelf lock includes a body portion formed of a bottom half and a top half resiliently joined thereto at an angle and defining a rectangular window. A resilient crescent-shaped protrusion is formed in the top half of the body portion and defines a shelf-engaging semicircular edge that extends substantially along the upper length of the window. A shelf support extends from the bottom half of the body portion in a direction normal thereto and flush with the bottom of the window. One or more reinforcing webs support the bottom of the shelf support to the bottom half of the body portion. A post extends from the bottom half of the body portion in a direction normal thereto but opposite to that of the shelf support and for a distance about one half of the shelf support. Preferably the post is fluted. Preferably, the angle between the top half and the bottom half of the body portion is about nine degrees. In lieu of the post, the shelf lock is provided with a metal pin for greater strength with much smaller diameter.

8 Claims, 10 Drawing Figures

LOW PROFILE SHELF LOCK

BACKGROUND OF THE INVENTION

1. Field of the Invention

The present invention relates generally to shelf supporting devices and, more particularly, to an improved low profile shelf lock of novel construction and designed to secure a shelf in a cabinet against displacement during shipment and/or use.

2. The Prior Art

In the manufacture of various types of cabinets or like products which incorporate shelves, it is desirable to make the cabinet not only so that the shelves be adjustable to different heights but also so that the cabinet can be shipped with the shelves installed and without the shelves becoming loose during shipment. In prior patents, this desirable feature already has been addressed, with various degrees of success. To wit, in U.S. Pat. No. 3,471,111, there is disclosed a combination of a shelf anchor and of a conventional shelf suport that cooperate to hold a shelf against displacement during shipment. In U.S. Pat. No. 3,471,112, there is disclosed a unitary shelf support and anchor including a planar resilient finger located in spaced relation above a shoulder designed to support a shelf. The finger deflects to permit a shelf dropping onto the shoulder and then springs out to prevent displacement of the shelf. And in U.S. Pat. No. 3,870,266, there is disclosed a self-locking shelf support provided with a plug adapted to be mounted in a wall socket. The plug is formed with an axial chamber to house a pin and a spring reciprocable therein. The retractable pin holds the shelfin place during and after shipment. There is still room left for improvements.

SUMMARY OF THE INVENTION

It is a principal object of the present invention to overcome the above disadvantages by providing a low profile shelf lock of improved construction for securing shelves in cabinets and the like.

More specifically, it is an object of the present invention to provide an improved low profile shelf lock of novel construction comprising a body portion formed of two integral halves resiliently joined to one another at an angle, with the two halves defining and forming a rectangular window; a resilient crescent-shaped protrusion formed in the top half of the body portion and defining a shelf-engaging semicircular edge extending substantially along the length of the top edge of the window; a shelf support projecting from the bottom half of the body portion in a direction normal thereto and flush with the bottom edge of the window; one or more reinforcing webs interconnecting the bottom of the shelf support with the bottom half of the body portion; and a post extending from the bottom half of the body portion in a direction normal thereto but opposite to that of the shelf support and for a distance which is about one half the projection of the shelf support. The post may be fluted or solid. If desired, in lieu of the post, a metal pin can be employed. Preferably, the angle between the two halves of the body portion is about nine degrees. Preferably, the shelf lock of the invention is formed of a plastic material as a unitary structure. The bottom half of the body portion is flat and is designed to lie flat against a cabinet wall. The top half of the body portion is designed temporarily to be displaced so as also to lie subtsantially flat against the cabinet wall when a shelf is secured therein. In this securing process, the shelf first comes up against the resilient crescent-shaped protrusion formed in the top half of the body portion, which protrusion resiliently is deformed by the action of the shelf during its downward passage toward the shelf support. Upon the shelf reaching the shelf support, the crescent-shaped protrusion snaps back into its original shape, with its shelf-engaging semicircular edge coming to rest on top of the shelf. The shelf is thus securely held in place between the shelf support at the bottom and the resilient crescent-shaped protrusion at the top.

Other objects of the present invention will in part be obvious and will in part appear hereinafter.

The invention accordingly comprises the shelf lock of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
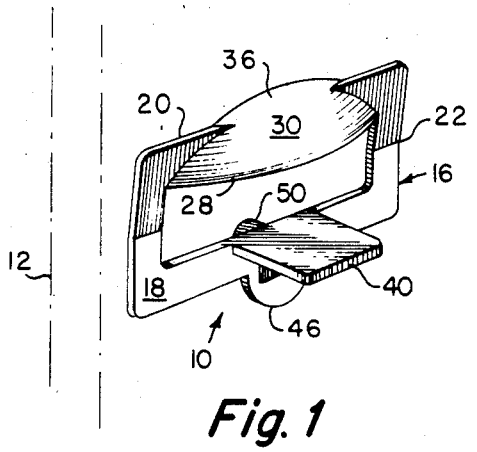
FIG. 1 is a front perspective view of a low profile shelf lock constructed according to the invention.
Figure 2:
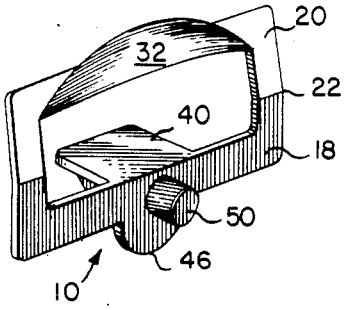
FIG. 2 is a rear perspective view of the shelf lock of FIG. 1.

In general, the drawings illustrate an improved low profile shelf lock 10 designed for releasably securing shelves to a vertical wall 12 in kitchen cabinets and the like. Preferably, the shelf lock 10 is formed of a suitable plastic material, such as acryls, nitryls, acrylonitrile butadiene styrene and the like by injection forming or a similar process. The plastic material generally is strong and rigid but has a certain amount of inherent resiliency. Typically, in kitchen cabinets and the like, the wall 12 is pre-drilled with a plurality of sockets 14 at varying levels of height. Consequently, any shelves involved can be adjusted to different heights, with the ultimate consumer setting the shelf height to his own particular needs.

The low profile shelf lock 10 comprises a body portion 16 formed of two integral halves: a bottom half 18 and a top half 20 resiliently joined to the former about midway, as at 22, and at an angle 24. Preferably, this angle 24 is about nine degrees. The two halves 18 and 20 of the body portion 16 combine to define and to frame a substantially rectangular window 26 therebetween. A resilient crescent-shaped protrusion 28 is formed in the top half 20 of the body portion 16. The crescent-shaped protrusion 28 is defined between a frontal convex side 30 and a rearward concave side 32. The convex and concave sides 30 and 32 taper from a thick shelf-engaging semicircular edge 34 toward a thin top edge 36. The shelf-engaging semicircular edge 34 extends substantially along the length of the top edge of the window 26, which top edge is for the most part in fact defined by the edge 34.

Figure 7:
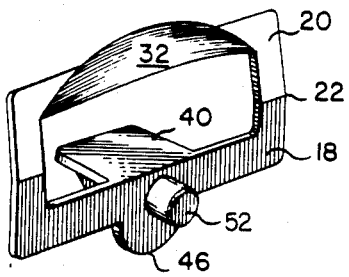
FIG. 7 is a view similar to FIG. 2 but showing a modification thereof.

A shelf support 40 projects from the bottom half 18 of the body portion 16 in a direction normal thereto and flush with the bottom edge 42 of the window 26. One or more reinforcing webs 44 interconnect the bottom of the shelf support 40 to and with the bottom half 18 of the body portion 16. Preferably, a semicircular extension 46 is formed centrally below the bottom half 18 and serves as additional support for the reinforcing webs 44. A post 50 also is shown projecting from the bottom half 18 of the body portion 16 in a direction normal thereto but opposite to that of the shelf support 40. Preferably, the post 50 is fluted and extends for a distance from the body portion 16 that is about one half the distance of the shelf support 40. In the alternative, a post 52 (note FIG. 7) can be employed, which is smooth, i.e., it has no flutes about its circumference, as does the post 50.

Figure 3:
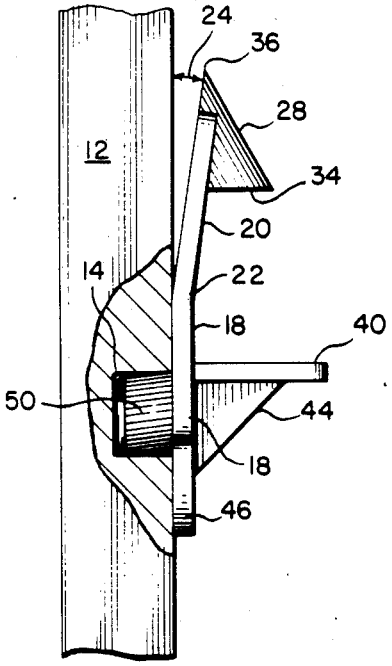
FIG. 3 is a side elevation, partly broken away, showing the shelf lock in operative position.

The bottom half 18 of the body portion 16 is flat, observe FIG. 3, and is designed to lie flat against the cabinet wall 12, with the post 50 snugly fitting into and within the socket 14. As mentioned, the top half 20 of the body portion 16 is integrally and resiliently joined thereto, as at 22, at angle 24, which preferably is about nine degrees.

Figure 4:
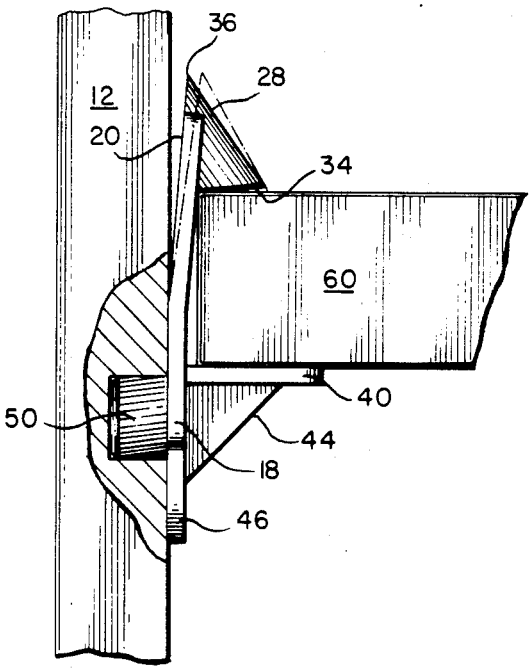
FIG. 4 is a view similar to FIG. 3 but showing a shelf in place within the shelf lock.
Figure 5:
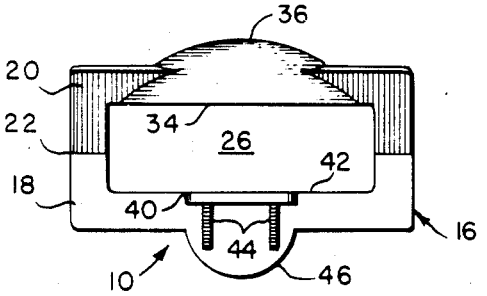
FIG. 5 is a front elevation of the shelf lock of FIG. 1.
Figure 6:
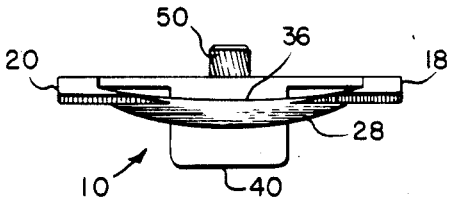
FIG. 6 is a plan view of the shelf lock of FIG. 1.

The function of the resilient crescent-shaped protrusion 28 and of the top half 20 of the body portion 16 is to be temporarily displaced, i.e., deflected toward the wall 12, under the action of an edge 58 of a shelf 60 when the same is lowered onto the shelf support 40, observe FIG. 4. As is customary, the shelf 60 is precut to length so that the opposite ends of the shelf will butt substantially against the forward faces of the now somewhat straightened body portion 16 of the shelf lock 10. There is thus no longitudinal play in the shelf 60 when the same is installed with the aid of two shelf locks 10 on each side and near the corners of the shelf 60. The protrusion 28 thus facilitates the positioning of the shelf 60. The shelf lock 10 also has a low center of gravity, due to its design, exhibiting little tendency to flip upside down even when the sockets 14 are slightly oversize.

With the shelf 60 in position and resting on the shelf support 40, as shown in FIG. 4, the resilient crescent-shaped protrusion 28 will snap out once the upper edge of the shelf 60 has cleared the shelf-engaging semicircular edge 34 thereof. At that point, the shelf-engaging semicircular edge 34 will engage the upper edge of the shelf 60 and will cooperate with the shelf support 40 firmly to hold the shelf 60 both against vertical and lateral displacement, even during rough shipment. If desired, the shelf 60 readily can be removed from the shelf lock 10 by pressing the resilient crescent-shaped protrusion 28 against the wall 12 until its shelf-engaging semicircular edge 34 clears the edge of the shelf 60 and then raising the shelf 60 clear of the shelf lock 10.

Figure 8:
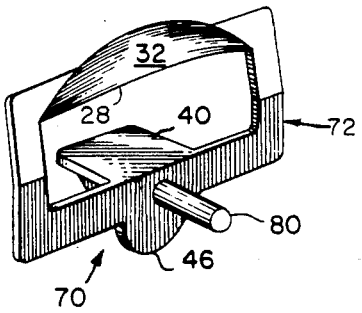
FIG. 8 also is a view similar to FIG. 2 but showing a different embodiment thereof.
Figure 9:
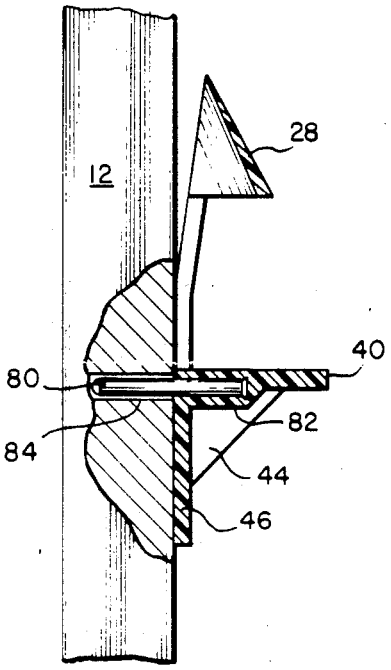
FIG. 9 is a view similar to FIG. 3 but illustrating the embodiment of FIG. 8 in operative position.
Figure 10:
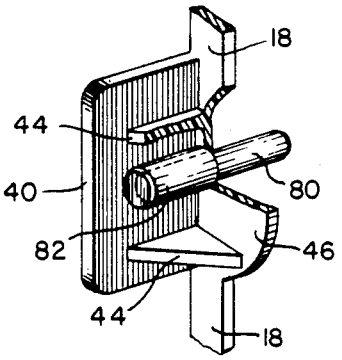
FIG. 10 is a fragmentary perspective view, on an enlarged scale, of the embodiment illustrated in FIG. 8.

In FIGS. 8–10, there is illustrated a different embodiment of a low profile shelf lock 70. Shelf lock 70 for the most part is like the shelf lock 10 above described, comprising a body portion 72 also formed of a suitable plastic material with the two integral halves, and including the crescent-shaped protrusion 28, the shelf support 40 and the semicircular extension 46. In lieu of the integral plastic post 50 however, the low profile shelf lock 70 features a metal pin 80, preferably formed of brass or stainless steel. Preferably, the shelf lock 70 also is injection formed in a suitable mold, not shown, in which the pin 80 previously has been inserted. The pin 80 is designed to be held firm in the body portion 72 within a convenient pouch 82 thereof formed concurrently therewith. The supporting pouch 82 is formed between the reinforcing webs 44 and on the underside of the shelf support 40 itself so as to give it additional strength. The pin 80 also differs from the post 50 in that the pin 80 extends from the body portion 72 for a distance that is about three quarters the distance of the shelf support 40, i.e., more than does the post 50. Consequently, the wall 12 this time is pre-drilled with a plurality of holes 84, which are both narrower and deeper than the plurality of sockets 14.

Thus it has been shown and described a shelf lock 10 designed for securing shelves in cabinets or the like, which shelf lock 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A shelf lock for securing a shelf between opposed cabinet walls having sockets formed therein comprising:

(a) a body portion formed of a bottom section and a top section resiliently joined thereto at an angle and defining a rectangular window therebetween;

(b) a resilient crescent-shaped protrusion formed in said top section of said body portion and defining a shelf-engaging semicircular edge extending substantially along the length of the top edge of said window;

(c) a shelf support extending from said bottom section of said body portion in a direction normal thereto and flush with the bottom edge of said window;

(d) at least one reinforcing web interconnecting the bottom of said shelf support and said bottom section of said body portion; and (e) a post extending from said bottom section of said body portion in a direction normal thereto but opposite to that of said shelf support;

(f) said resilient crescent-shaped protrusion defined between a convex side protruding from said top section of said body portion in the same direction as said shelf support and a concave side, said convex and concave sides tapering from said shelf-engaging semicircular edge at the bottom thereof toward the top of said crescent-shaped protrusion;

(g) said top section of said body portion resiliently joined to said bottom section at said angle so as to extend therefrom inclined in said direction of said shelf support.

2. The shelf lock of claim 1 which is formed of a plastic material as a unitary structure and wherein said bottom section of said body portion is flat and is designed to lie flat against said cabinet walls, and said top section is resiliently joined thereto at an angle of about nine degrees, and wherein said top section of said body portion is designed temporarily to be displaced so as also to lie flat against said cabinet walls when said shelf is secures therein.

3. The shelf lock of claim 1 wherein the size of said window between its top and bottom thereof is about the same as the extension of said shelf support from said body portion, and wherein said body portion further includes a semi-circular extension formed centrally below said bottom section thereof.

4. The shelf lock of claim 1 wherein said post is fluted.

5. The shelf lock of claim 1 which is formed of acrylonitrile butadiene styrene and wherein said shelf is intended to engage and deform said convex side portion of said crescent-shaped protrusion prior to its coming to rest on said shelf support, wherein said shelf support and said shelf-engaging semicircular edge of said resilient crescent-shaped protrusion combine securely to hold said shelf therebetween and wherein said resilient crescent-shaped protrusion serves to prevent any longitudinal play of said shelf.

6. A shelf lock for securing a shelf between opposed cabinet walls having sockets formed therein comprising:

(a) a body portion formed of a bottom section and a top section resiliently joined thereto at an angle and defining a rectangular window therebetween;

(b) a resilient crescent-shaped protrusion formed in said top section of said body portion and defining a shelf-engaging semicircular edge extending substantially along the length of the top edge of said window;

(c) a shelf support extending from said bottom section of said body portion in a direction normal thereto and flush with the bottom edge of said window;

(d) at least one reinforcing web interconnecting the bottom of said shelf support and said bottom section of said body portion; and (e) a pin extending from said bottom section in a direction normal thereto for a distance that is about three-quarters the length of said shelf support; said pin being held firm within a pouch formed integral with said body portion;

(f) said top section of said body portion resiliently joined to said bottom section at said angle so as to extend therefrom inclined in said direction of said shelf support.

7. The shelf lock of claim 6 wherein said body portion is formed of one of the group including the acryls, the nitryls and butadiene styrene.

8. The shelf lock of claim 6 wherein said pin is formed of one of the group including brass and stainless steel.

* * * * *